United States Patent [19]

Hamel, Sr.

[11] Patent Number: 4,581,504

[45] Date of Patent: Apr. 8, 1986

[54] CIRCUIT BREAKER CABLE AND BATTERY POST SWITCH

[76] Inventor: Luis P. Hamel, Sr., 14914–33rd Ave. N.W., Gig Harbor, Wash. 98385

[21] Appl. No.: 707,175

[22] Filed: Feb. 28, 1985

Related U.S. Application Data

[63] Continuation-in-part of Ser. No. 479,872, Jan. 5, 1984, abandoned.

[51] Int. Cl.[4] ..... H01H 35/00

[52] U.S. Cl. ..... 200/61.08; 200/61.45 R

[58] Field of Search ..... 200/61.45 R, 61.5, 61.68, 200/159 B; 180/271, 274, 277, 279, 282

[56] References Cited

U.S. PATENT DOCUMENTS

| | | | |
|---|---|---|---|
| 3,261,423 | 7/1966 | Scioloro | 180/279 |
| 3,743,803 | 7/1973 | Ruesch et al. | 200/61.45 R |
| 3,792,211 | 2/1974 | McGuffey | 200/61.45 R |
| 3,798,399 | 3/1974 | Curporandy | 200/61.45 R |
| 4,519,474 | 5/1985 | Iseli et al. | 200/159 B X |

*Primary Examiner*—J. R. Scott

[57] ABSTRACT

An electrical circuit breaker in which the circuit is immediately broken by concussive distortion to the unit housing which is secured to a vehicle or aircraft powered by an internal combustion engine utilizing a storage battery as an electrical energy source. The circuit breaker consists of a non-conductive tube containing a series of interlocking insulating cones each having a conductive core forming a connection which is the equivalent of a cable completing the electrical circuit with a break-away feature which insures disconnection automatically upon distortion for fire protection. Concussive distortion of the tube instantly and permanently separates the cones and breaks the circuit.

5 Claims, 5 Drawing Figures

CIRCUIT BREAKER CABLE AND BATTERY POST SWITCH

This application is a continuation-in-part of application Ser. No. 479,872, filed Jan. 5, 1982, now abandoned.

BACKGROUND OF THE INVENTION

Field of the Invention

A prime source of accidental injury and death is due to the extensive use of automobiles and aircraft by a modern mobile society. In previous years the body of a motor vehicle was constructed for strength and durability. This was considered a safeguard against accidental injury and death. However, current needs for better fuel economy without sacrificing speed have prompted a change in the type and weight of metals used, and have precipitated the use of plastics and fiberglass in the manufacture of automobiles. Consequently, extensive damage is more readily sustained even in low speed collisions by vehicles with the current lightweight unitized bodies. In a crash, doors and windows may jam; fuel tanks may rupture or spill their contents. The highly volatile nature of the fuel creates an explosive situation. Smoldering plastics produce toxic gas. The tragic results all too often are occupants hopelessly trapped within a veritable inferno, subsequently injured by fire and toxic smoke inhalation, or needlessly burned to death. This situation is further aggravated by the requirement of seat belts, infant carrier restraints and air bags which reduce injuries caused by the impact, by restrict chances of escape and survival from fire.

Rarely is the exhaust system of the internal combustion engine hot enough to ignite the fuel. Fuel, though hazardous when spilled, is still manageable if ignition is prevented. The primary cause of fuel ignition originates from the electrical system. And, more particularly, from an electrical circuit in which the positive flow of electrical current is exposed, thereby creating the opportunity for sparking and arcing. The relatively high mobility and ease with which electrons can be caused to move through a variety of materials are important properties of all electrical phenomena. Therefore, a device to control and break this motion during an accident must insure that no contact or even near contact which may complete the circuit can be made even in a partially or totally destroyed condition.

Accidental injury and death are also due to the use of aircraft which, while they share the needs of automobiles for a safe and effective means to interrupt electrical circuitry in the event of a crash, present specific requirements of a circuit breaker, the subject of the present invention.

The scope of this safety device extends to further protect against injury to automotive service personnel and damage to equipment in the electrical system of the vehicle in which the circuit breaker and bypass switch are installed. During general operation and maintenance of the vehicle the bypass switch function addresses several needs a vehicle owner has relating to protection for, and from, the electrical system of the automobile.

More specifically, there are two types of storage batteries available for use in the electrical system of vehicles; the conventional top mount battery having exposed terminal posts and the newer side amount battery having internal terminal connections. A majority of automobiles are equipped with conventional cables fitted with terminal clamps, but for a variety of reasons a side mount battery is installed. Fulfilling the need for a simple method of adapting the side mount battery for use with conventional cables is a feature of this invention and a useful accessory to the automotive electrical system.

It is within the scope of this safety device to prevent ignition of fuel and its fumes by electrical sparking and arcing imparting greater security to the victims of collision or crash utilizing seat belts, infant carrier restraints and air bags in vehicles or aircraft.

DESCRIPTION OF PRIOR ART

Circuit breakers, as is known, are generally described by the method employed to extinguish the arc caused by breaking an electrical circuit. Their function is to protect against fire, explosion and electrocution. Conventional circuit breakers are keyed to overloaded circuits, as is also true with fuses. A fuse is another known device which breaks a circuit. Fuses function on the principle that the destruction of the fuse element upon need will protect against fire, explosion and electrocution. Circuit breakers used in the electrical system of a vehicle or aircraft must address a unique problem. While the need for protection is present, in a crash the circuit is not overloaded. Hence, the protection extended by a conventional circuit breaker or fuse is insufficient in this case and the presence of hazard remains.

Heretofore, some other circuit breakers attempting to function within the environment of motion inherent in vehicles have employed either an inertia mass embodied in the pendulum tumbler, or a jointed weight including various parts, or a glass tube containing mercury known as the mercury switch.

The disadvantages of these known circuit breakers involve the inability to mount them on the terminals of the storage battery which is the electrical point of supply offering the most advantageous fire protection, the permanent loss of electrical circuitry due to the inability of the circuit breaker to restore continuity to the circuit following interruption, and the high cost of the circuit breaker at the point of purchase.

In the case of the mercury switch, the current passes through the fluid mercury contained in a tube and interruption is accomplished when all the current carrying mercury flows in one direction creating a gap sufficient in length to resist arcing. The disadvantages of this system are based in impracticality since the fragile glass tube is easily fractured, and the variation in level due to the motion inherent in the use of a vehicle or aircraft will cause the liquid to move, intermittantly interrupting the flow of current which makes operation unreliable.

Further, inadequate fire protection occurs unless the circuit breaking device can disconnect the current flowing in the entire electrical system. To accomplish this, interrupting the circuit at the point of supply is superior to disconnecting only a portion of the circuit, as is accomplished when only the ignition circuit is grounded as found in anti-incendiary devices employing an inertia mass. In this instance, the risk of fire is reduced, but the potential for fire occurs from within the intact electrical system. An example of this risk resides in the electrical motors used in blowers found within engine and passenger compartments of both vehicles and aircraft. The sparking caused as the armature and the brushes make contact produces a danger of ignition of volatile fumes.

Another circuit breaker attempting to provide protection for vehicles from the ignition of spilled fuel has utilized a mass through which an electric current is passed and which is elastically maintained in a certain position which will upon collision be displaced from its normal position thereby breaking the electrical circuit that is maintained while in the suspended position. This method is employed by the inertia switch.

The fact that the contact on an inertia switch, as described, is elastically maintained by a spring, makes it susceptible to being dislodged accidentally. On a vehicle employing an inertia switch the electrical circuit could be needlessly disconnected by a simple bumper to bumper incident where no danger of fire exists while the car is parked, or in a minor collision during operation. In the former case, the problem of accidental disconnection is a nuisance, however in the latter case, such a disconnection during operation impedes safety, and is a distinct disadvantage.

The problem of accidental dislodgement makes previous circuit breaking devices utilizing the displacement of a mass, of an articulated weight or of a current carrying liquid, unsuitable for use on aircraft. The electrical circuit necessary for safe continuous operation could be disengaged upon impact during a rough landing, or worse yet, from shock during turbulence while in flight. Resetting the inertia switch mass or weight following an accidental dislodgement in a timely manner is impractical, and resetting the mercury switch requires uninterrupted level flight. Plainly, no known circuit breaking device addresses this substantial problem, and provides adequate protection for aircraft.

In the anti-incendiary device for automotive vehicles the grounding of the ignition system presents a problem for the motorist involved in a collision. When the inertial mass is displaced, the ignition system is grounded. The grounding institutes discharging of the storage battery. if there are injuries at the site of the collision, resetting the device may be delayed, in which case the storage battery could be discharged by the time resetting takes place. The result being that following resetting, the potential for continuity serves no purpose if the electrical power source is discharged. Restoring power would be difficult without a boosting charge that would transfer power from a charged battery into the discharged battery thereby taking the risk that either vehicle may incur damage to the alternator within the electrical system.

When engaged the starter motor used in an internal combustion engine receives significant stress as it overcomes the compression of the engine. In order to function, ample current and tight electrical connections are required by the starter. If electrical devices use springs to make a connection, the spring must create enough pressure to hold the contact surfaces securely. For continuous current a spring must also be unaffected by vibration or fatigue. Conductive members must be of sufficient breadth and dimension to carry an adequate supply of current. In the event that a small or thin conductor is used, or a loose contact is made, overheating will occur at those points. This heat causes the metal of a thin conductor to deteriorate, and the point of a loose connection to burn, or fuse in position.

Continuing this line of reasoning, the inertia switch concept that utilized connections to the positive pole of the lead-acid accumulator presents additional problems. When the mass is held by the charged piston, the amount of surface area touching the sphere is meager. In the absence of insulating solutions, and over the period of time the switch is installed in the vehicle, the charged piston may fuse to the metal sphere, subsequently precluding both function upon need and resetting.

The procedure for resetting the inertia switch assumes that the switch has not been damaged by the crash. Should such damage occur to the circuit breaking switch, resetting is impaired.

Moreover, during the events of a collision the vehicle is not always level or even upright. Should resetting of the inertia switch be necessary while the vehicle is on a hill, an uneven or angled surface, gravity would not cause the mass to return automatically to a centered position. The premise of the gravity return of the sphere assumes that the vehicle will always be in an upright, level position, which is not the case in practice. The disabled vehicle without the use of lights is unable to mark the location, and when visability is poor the hazard factor is increased.

These problems inherent in the existing inertia switch concept, and in the actual altered function of the inertia switch within the environment and events concurrent with operation and collision of vehicles and aircraft suggest advancement of the art is indicated so as to provide more efficiency and greater safety in anti-incendiary circuit breaking safety devices used under stressful conditions.

The need for protection of automotive service personnel from accidental engine operation when a vehicle is receiving maintenance is an additional problem included as a feature of this invention. This problem is commonly handled by disconnecting the cable clamps on the storage battery. The removal of the battery clamp often becomes laborious due to the build-up of corrosion which tends to impact the nut and bolt. After attempting the detach the nut and bolt with a variety of hand tools, a clamp puller may be used. This process is extremely time consuming for professional service personnel in a situation where proper time management is important. Frequently service personnel will decide to proceed with the maintenance of repair without disconnecting the power source thereby risking many kinds of personal injury. The solution to this problem requires a method of isolating power at the battery wherein frequency of use does not impair the circuit breaking function.

In the inertia switch, provision for the isolation of power has sometimes been provided. This method of isolation was planned for security during storage, a matter of infrequent use. However, even for infrequent use disadvantages exist in the combination of the single set screw mounting on a terminal post giving less resistance than necessary to maintain the unit installation when the upward pulling force necessary to reset or isolate power is applied. Repeated use of the pull knob loosens the unit from its installation, and repeated tightening of the set screw to adjust the unit damages the terminal post. Frequent isolation of power as necessary for vehicle servicing by the pull knob method impairs the security of the device mount, as does the common build-up of corrosion around the terminal post. As stated earlier, any loose connection can create the opportunity for overheating resulting in burning and fusing.

A frequent source of a vehicle being in a non-operational condition is due to a discharged battery resulting from neglect to the automotive electrical system and lack of frequent operation which would ordinarily keep the system charged. This non-operability may occur in any locale where a service station is not always near. The transference of power from the charged storage battery of another vehicle into the discharged storage battery commonly called boosting, has been the usual method of handling this dilemma. However the electrical system of the vehicle providing the power risks damage to the alternator any time a power transference takes place.

The resolution of these additional problems would be an aid to both automotive service personnel and motorists on the road affording greater efficiency and less risk incurred as a result of operating the motor vehicle.

SUMMARY OF THE INVENTION

The circuit breaker according to the invention is a sealed, hollow, rigid, cylindrical non-conductive tube of optional length containing a series of cones, each having a conductive core. The cones are vacuum packed inside the tube if excessive temperature variations exist within their functional environment. When the cones are interconnected, comprising the equivalent of an electrical cable, electrical current is conducted. The assembly connects the storage battery ground circuit to the opposite side of the engine and provides a breaker section of cable within the tube. In the event of a collision, the inherent concussive distortion will bend or fracture the tube, separating the segmented conductive core cones, thereby breaking the electrical circuit. Restoration of the circuit is easily accomplished by use of the manual bypass switch mounted on the storage battery, the function of which is not dependent upon the circuit breaker being in operable condition, or on the vehicle or aircraft being positioned on a level surface. Isolation of power at the battery is also easily done, and may be done repeatedly with no adverse effects to the bypass switch. Frequent isolation of power is advantageous during servicing and power transference commonly called boosting.

The invention addresses the need to improve the safety of vehicles, and specifically aircraft,powered by internal combustion engines which use a lead-acid accumulator as an electrical energy source. By disconnecting the source of the electrical current, this safety device precludes the ignition of spilled fuel or its fumes by sparks from the electrical system of a vehicle or aircraft which has sustained extensive structural damage. Ignition of fuel is the major cause of fires resulting from collision and crash. The existence of both established and proposed legislation requiring mandatory use of seat belts, infant carrier restraints and air bags emphasizes the danger present in the operation of a vehicle, and suggests that safety within the vehicle for the survivors of a crash must be optimized since escape therefrom is hampered by the point-of-impact safety equipment. Thus, it is the object of this invention to furnish a device which, when used separately or in conjunction with seat belts, infant carrier restraints and air bags, and employed by vehicles and aircraft which are engine driven, will increase safety.

The object of this invention is specifically accomplished by instantly and reliably breaking the electrical circuit if the structural integrity of the craft or vehicle is distorted, as occurs in a major crash or collision. More particularly, the breaking of the circuit is accomplished in such a safe and advantageous manner that the connection made by the cones will be permanently disengaged even by the slightest alteration in the integrity of the tube in which the cones are contained.

The chain of cones, being the equivalent of a cable, completes the ground circuit. Therefore, the recessed conductive core within the non-conductive cone shell at the point of distortion does not have an electrically live surface. A further safeguard against arcing caused by an exposed live surface exists in the convex cap screw shield which fits over the current carrying convex cap screw present in electrical series to the energy source.

Importantly, since this circuit breaker actuates automatically upon partial or total destruction, the principle function of the circuit breaker moves in accordance with the primary concussive force of impact. The more extensive the distortion; the more the function of the circuit breaker is reinforced. The destruction of the current carrying member upon need produces the circuit breaking protection. Damage by the events of a collision will not alter the function of the concussive distortion circuit breaker.

There are further advantages inherent in the distortion concept, since you can have impact without distortion. In the absence of significant distortion, as in a simple bumper to bumper incident, the vehicle would still be operational, hence the nuisance factor of accidental dislodgement caused by minor impact is eliminated. The hazard of unexpected disconnection is also avoided because the circuit breaker does not break the circuit without significant distortion to the vehicle or aircraft, and is of particular significance in the use of this circuit breaker on aircraft. If there is distortion that is substantial enough to a vehicle to break the circuit, the vehicle will have also been stopped by such a force at the same time.

The premise of concussive distortion makes this invention practical as a safety device on automobiles in which occupants are complying with seat belt and infant carrier restraint laws or proposed legislation on air bags and are thereby constrained from escape. It is also practical on aircraft guarding the survivors of a crash from subsequent fire caused by the electrical system while they may be unconscious and still strapped in their seats. Another object of this invention is to supply a fire safety device including the means of disconnecting the electrical system automatically upon concussive distortion.

The advantage of the cable equivalent break-away cone series is that this accomplishes mechanically in response to concussive distortion what the fuse element accomplished in response to heat overload within the circuit. The absence of moving parts to accomplish the circuit breaking function provides more control over when the circuit is broken and reduces the opportunity for error.

Another object of this invention is to provide a fire safety device including the means of disengaging the electrical system automatically upon concussive distortion, and provide the means to restore the electrical circuit by the actuating of a simple manual bypass and shut-off switch at the battery terminal connected to the deactuated position thereby restoring the vehicle or aircraft to operational capacity without dependency upon the circuit breaker surviving the crash intact, or upon the vehicle or craft being positioned on a level surface in order to insure a specific directional relationship to the force of gravity.

The advantage of separating the two functions of circuit breaking and restoration of power serves to increase the opportunity that following a crash resetting would be possible and desirable. The bypass switch is made to restore the battery supplied electrical system to service. If the bypass switch, which is mounted to the battery, is destroyed by the crash, in all likelihood the battery itself would be destroyed with it.

Another object of this invention is to provide an easily operated means, wherein no damage is incurred by frequent use, for disconnecting the electrical system by the isolating of power through the use of the bypass switch contacting the neutral position preparing the vehicle or craft in a time efficient manner for servicing while protecting the service personnel doing the maintenance from personal injury, and providing a means to protect the function of the alternator within the electrical system of the engine driven vehicle, should the vehicle be used as a source of electrical charge for a second vehicle wherein the transference of electrical power from a charged lead-acid accumulator to a discharged lead-acid accumulator takes place.

A further object of this invention is to provide protection from fire in a unit that is compact, lightweight unaffected by temperature variation, easily replaced and easily installed into a vehicle or aircraft which can be made available to persons in every income bracket by virtue of its inexpensive manufacture.

These general objects as well as more specific objects will be fulfilled in the apparatus the details of construction and operation herein described and claimed, with the following drawings forming a part hereof, wherein like numerals refer to like parts throughout.

DETAILED DESCRIPTION

Figure 1:
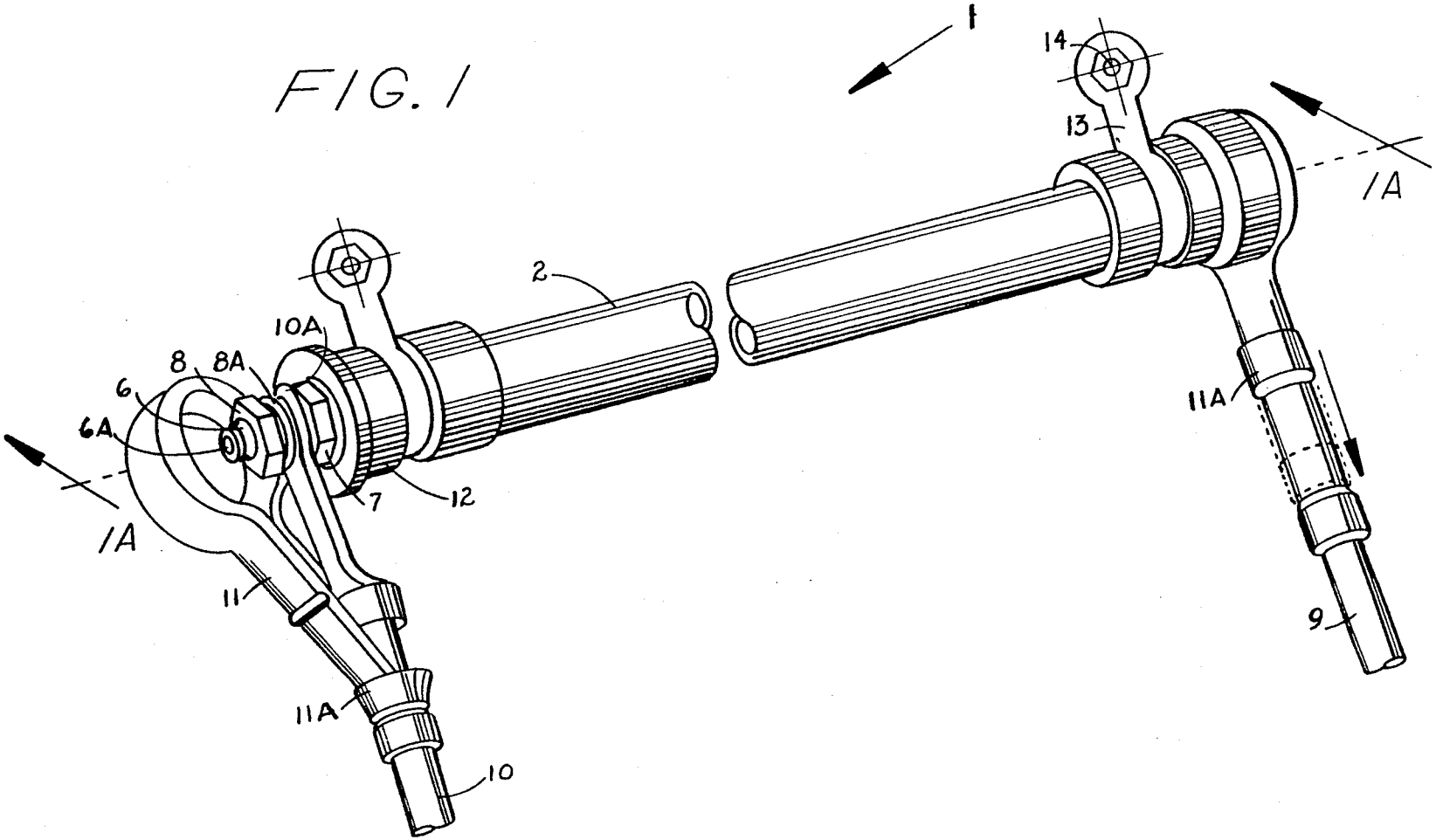
FIG. 1 is an isometric external view of the concussive distortion circuit breaker effectively safeguarding the electrical system.

Referring to the drawings and first to FIG. 1, an isometric view showing the external arrangement of the perferred embodiment, the device, a circuit breaker , is denoted generally by the number 1. A hollow non-conductive tube 2 houses a series of vacuum packed interlocking cones (not shown) Each cone having a conductive core connecting to conducting cap screws (not shown) which provide a single circuit coupling function and are contained within threaded non-conductive caps 12 at each end of tube 2. Rubber cover 11 is removed by sliding rubber locking sleeve 11A down onto either battery connecting cable 9 or ground cable 10. Ground cable end 10A is fastened on the end of cap screw 6 by lock nut 8 and 8A. Cap screw 6 is adjusted at point 6A by a hexagonal wrench (not shown) and couples to cone nose 3C at point 6B. Nut 7 locks cap screw 6 in place within tube cap 12. Steel mounting brackets 13 fit into recessed groove on tube cap 12. Mounting screws 14 hold brackets 13 on body of craft or vehicle. Use of multiple mounting brackets may be necessary to create unified movement of circuit breaker and craft body structure.

Figure 1A:
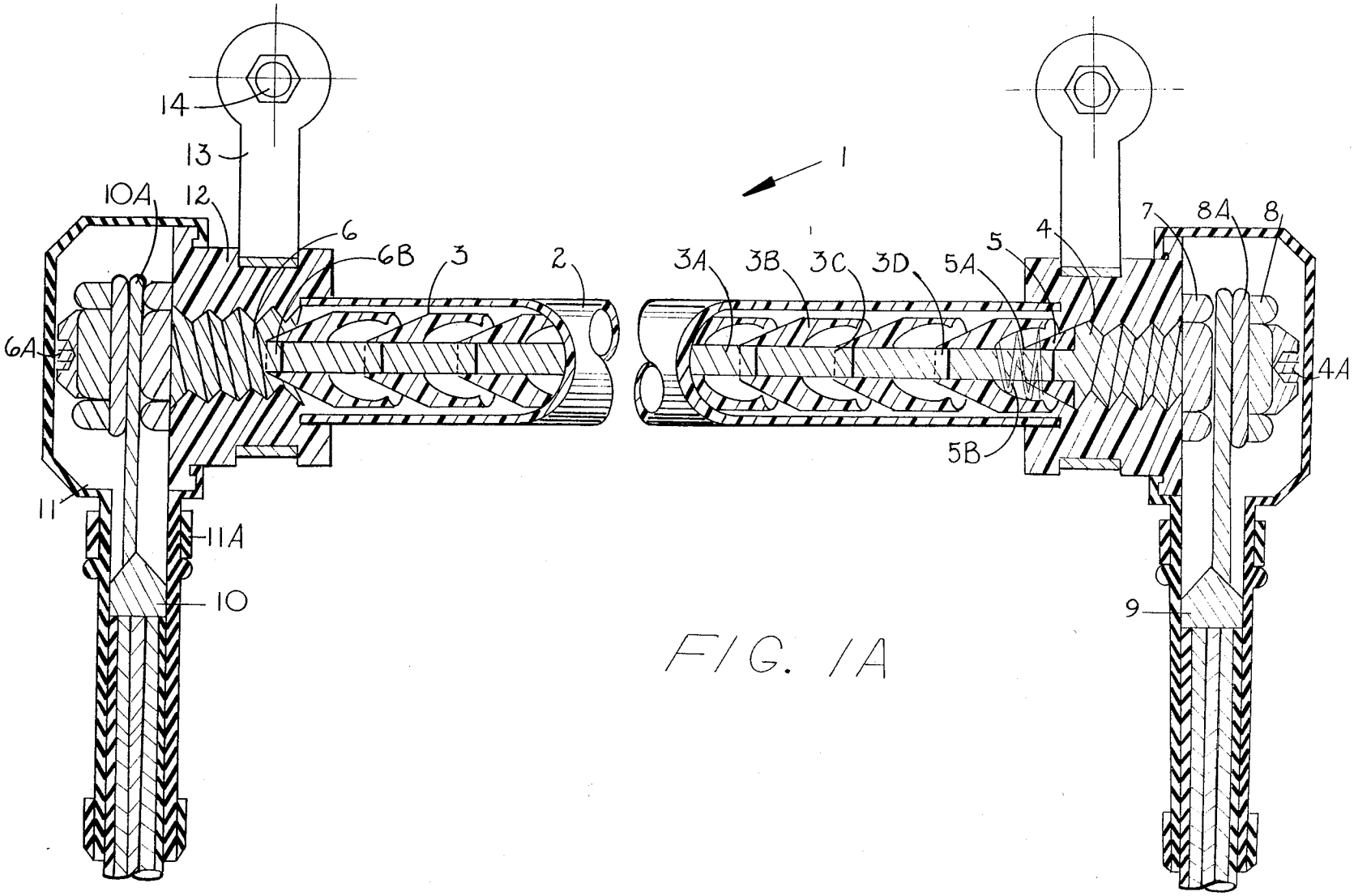
FIG. 1A is a cross sectional view of the circuit breaker assembly showing the internal arrangement taken on line 1A in FIG. 1.
Figure 3:
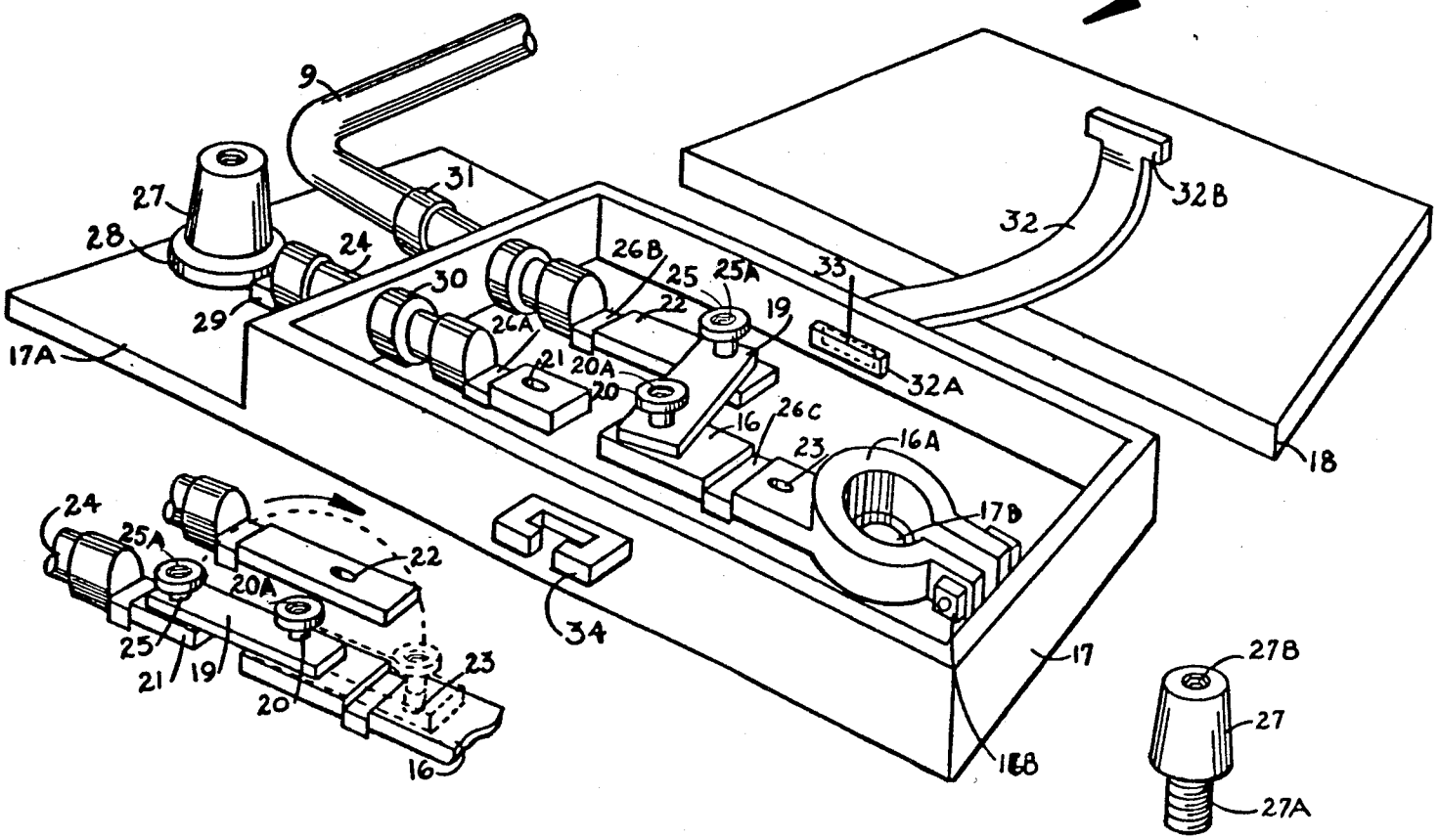
FIG. 3 is an isometric view of the detail of the battery bypass switch showing the deactuating bypass, the actuating and neutral isolation contact points, the switch shield and lid, and the detail of the junction post.

FIG. 1A is a cross sectional view of the circuit breaker assembly taken on line 1A of FIG. 1 and showing the internal arrangement. The subject of the invention is shown to be a sealed, cylindrical housing 2, tubular in shape. For purposes of the illustration the tube appears to be short but, in fact, the length and diameter are optional to conform to the applicable span which it is to cover. The tube 2 is of a non-conductive material such as rigid plastic. Tube 2 contains a series of cone shaped segments 3. A conductive core 3A is molded into the cones, the non-conductive shell of cone 3B surrounds the conductive core completely. The nose of each of the cones is blunt and has an orifice 30 centered in it. The conductive core 3A is recessed within the orifice 3C. The broad bottom of the cone is a hemispherical hollow and the conductive core 3A protrudes into the hollow space, but not so far as to project out of the bottom of the cone 3. The hollowed bottom of the one cone is shaped to accommodate the nose of the second cone. The latter cone nose orifice 3C fitting around the connecting protrusion 3D of the former cone. Thus, when the cones 3 are loaded in plurality into tube 2, they interlock nose orifice 3C to end protrusion 3D with all the conductive cores 3A connecting thus forming the circuit carrying member 3A in its entirety. The cones 3 are held in position by pressure applied by conductive cap screw 4 and 6 reinforced by tension spring 5B atop shield 5. Cap screws 4 and 6 each have an opening 4A and 6A respectively to permit the insertion of the hexagonal wrench (not shown) which is used to adjust the cap screws. Cap screw 4 has a projection in like dimension to the conductive core 3A which couples to cone protrusion 3D. Covering this conductive projection is a convex protective non-conductive shield 5 with orifice 5A in the center. The conductive protrusion 3D within the hollow of interlocking cones 3 connects through orifice 5A in shield 5 to the conductive projection of cap screw 4. Cap screw 6 has a concave tip with a protrusion 6B in the center which is of a length and diameter to fit into and couple with the nose orifice 3C of interlocking cones 3. Cap screws 4 and 6 are locked in place by cap screw lock nuts 7. Battery cable 9 and ground cable 10 are secured by lock nuts 8 and 8A. Battery cable 9 carries the current from the storage battery to the circuit breaker 1. Ground cable 10 receives the current from the circuit breaker and completes the ground circuit by connecting to the engine on the side opposite that of the battery mount. Removable rubber covers 11 insulate the cable ends and are held closed by sliding sleeve 11A. Each of the ends of tube 2 are fitted and affixed permanently by an adhesive compound with a non-conductive cap 12. The mounting brackets 13 are clamped around caps 12. The interior of the tube caps 12 is threaded to accommodate the convex cap screw 4 and the concave cap screw 6. The assembly is mounted across the engine compartment, vehicle bumper or aircraft fuselage and fastened at opposite ends by mounting brackets 13 and screws 14. The fastening is secured so as to cause the body of the craft and the circuit breaker 1 to receive any concussion in unison. Therefore, if the integral structure of the vehicle or craft is impaired, the breaker tube 2 acting in unison is either severed or bent, which separates the cones 3 and interrupts the circuit by permanently breaking the conductive center core at points 3C and 3D. After danger of fire has subsided the electrical circuit may be restored by switching over to the conventional direct ground contact point means 21 at the manual bypass switch 15. Refer to FIG. 3 for specifics of the bypass switch 15.

Figure 2:
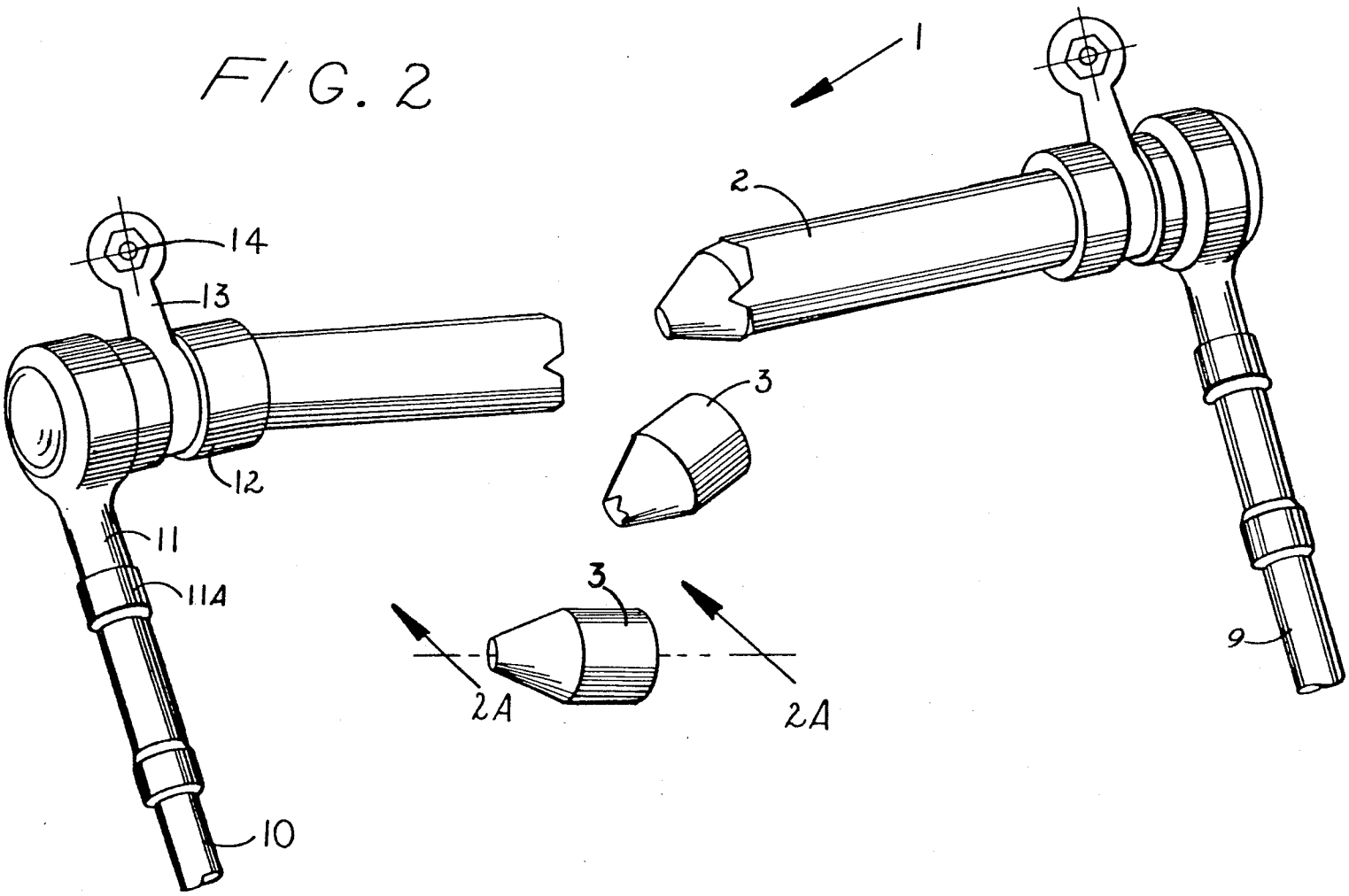
FIG. 2 is an isometric view of the circuit breaker after distortion has taken place, the cones have separated and the electrical circuit has been broken.

FIG. 2 is an isometric view showing the result of concussive distortion on circuit breaker 1. The breakaway feature present in the linkage of cones 3 is contingent upon the particular manner in which the interlock is achieved, that is, the strategic weakening of the link is accomplished by spacing the fitting of the latter cone conductive core at a distance equal to half the length of the nose section away from the bottom edge of the former cone thus the length and position of each conductive core is insuring that the segmental placement of cone shells 3B in relationship to each other is retained. The nose orifice 3C of the latter cone overlaps the conductive core protrusion 3D of the former cone. While it in no way structurally strengthens cone shell 3B, the connection made by the conductive cores is thorough. The size of the core 3A is sufficient to carry current in the amount necessary for operation of the vehicle or craft. More particularly, the cone shell 3B thins as it approaches nose orifice 3C; thickens at the central point of cone 3, and posteriorly contains a hemispherical space comprising a hollow wherein the conductive core is centered allowing adequate space therein for motion between the exterior of the latter cone nose and the interior of the posterior hollowed cone shell. This action, incorporated with the proper spacing of the cone shells 3B, and the construction of the tube 2 in a material such as rigid plastic, will respond to concussive distortion by bending, fracturing and otherwise separating, thus permanently disengaging the current carrying member of the circuit breaker 1 and precluding the chance of electrical sparking and arcing. Even if convex cap screw 4 is exposed by the events of a collision, convex cap screw shield 5 will insulate the recessed protrusion of cap screw 4, effectively obstructing the passage of electrical current.

The disconnecting of circuit breaker 1 in the manner so described will prevent fires but, it will also temporarily prevent the operation of the vehicle, which may be restored by the manual movement of lock down securing screw 25 and conductor bar 19 to the first contact point 21 on bypass switch 15. Connection rotatably and threadedly made by screw 25 to contact point means 21 deactuates and bypasses circuit breaker 1 to restore continuity.

Figure 2A:
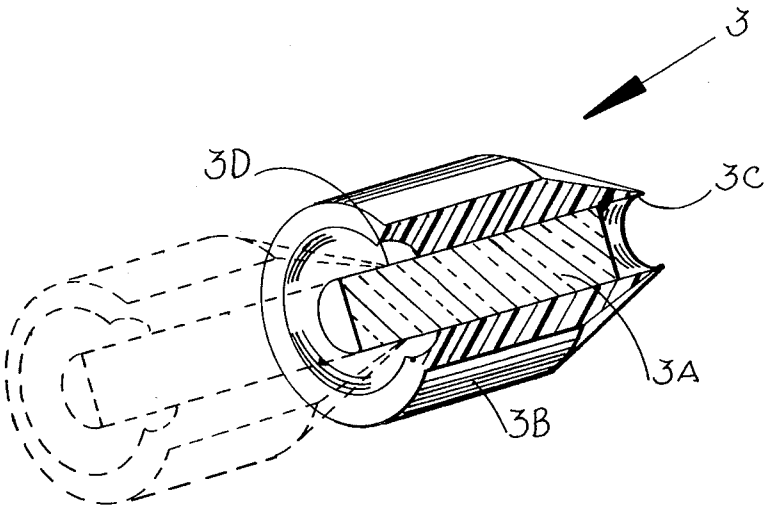
FIG. 2A is a cross sectional view of the detail of a cone taken on line 2A of FIG. 2. The spaced relationship of the strategic interlock is illustrated.

FIG. 2A views the cone 3 in cross section illustrating the cone shell 3B having a nose orifice 3C, and a recessed conductive center core protrusion 3D within its hollow. Each cone 3 being so similarly constructed that the nose orifice 3C of the following cone fits over the protruding conductive core 3D of the preceding cone making a continual interlocking series of cones which comprise the equivalent of an electrical cable with a break-away feature facilitating fracture upon the event of concussive distortion to the tubular housing 2. Positioned between and coupled to convex cap screw 4 and concave cap screw 6 the interlocking cones are held under pressure, adjustment to which may be made with the hexagonal wrench (not shown) inserted into openings 4A and 6A. Reinforcement of the tension on the cones is accomplished by tension spring 5B. With the cones 3 in an interlocking condition as shown in FIG. 1A, that is, with the conductive cores 3A all forming the equivalent of a conductive cable and with the convex cap screw 4 and the concave cap screw 6, both being conductive, engaged to the cones and also to battery connecting cable 9 and ground cable 10 continuity is provided through the circuit breaker 1 located between the storage battery and the grounding point on the engine when bypass switch 15 is in the actuated position, that is having conductor bar 19 attached by lock down screw 25 to second contact point 22 as illustrated in FIG. 3.

FIG. 3 shows the detail of the exterior of the bypass switch 15 in the preferred embodiment from an isometric view. The base member 16 incorporates a battery clamp 16A integrally formed which is attached directly to the post of a typical lead-acid accumulator. The bypass switch base member 16 is supported by a tough, non-conductive shield 17. Shield 17 has a rear horizontal extension from the bottom panel 17A which supports the connections to the conventional ground circuitry cable 24 and cable 9 connecting to the circuit breaker 1. Two methods for mounting the bypass switch to a storage battery are provided. The first method employs clamp 16A attaching directly to the existing post of a top mount battery by means of nut and bolt 16B. The entrance of the battery post is provided through an opening in the shield at point 17B. The second method utilizes ground cable junction post 27 which has an integrally formed mounting screw shaft 27A on the bottom plane. The junction post unit 27 is relocated and threadedly connected to the interior connection point of a side mount battery. The junction post 27 so connected then provides an exterior post upon which the bypass switch 15 may again be mounted employing clamp 16A and nut and bolt 16B when junction post 27 inserts through opening 17B. The existing side mount ground cable from the engine compartment of a vehicle can then be threadedly attached in the opening of cable end disc 28 where junction post 27 was removed.

Conductor bar 19 1a conductive connecting members is affixed to base member 16 by pivot screw 20. Conductor bar 19 swings in a one hundred eighty degree arc from pivot screw 20 to make a first contact point 21, a second contact point 22, and a third contact point 23. The first contact point means 21 establishes a connection to the conventional ground circuitry through cable 24 which effectively bypasses the circuit breaker 1. The second contact point means 22 establishes a connection to the circuit breaker 1 via battery connecting cable 9. The third contact point means 23 establishes a point at which the electrical power source is isolated. Neutral contact point 23, an opening interiorly threaded in base member 16, provides a safeguard while the vehicle is being serviced and insures that the installation of the bypass switch 15 will not be affected by the need for removal of it when servicing is done. Contact points 21, 22 and 23 are established by locked down securing screw 25 which insures a tight connection at the chosen contact. Both securing screws, including pivot screw 20 and lock down screw 25, have broad serrated heads to facilitate manipulation by hand without the use of tools. However, in the event securing screws 20 and 25 become impacted, an opening 20A and 25A in each screw head will receive a hexagonal wrench ( not shown ) which when inserted into the opening in the screw head and rotated will loosen the screw for resetting. Thus, if conductor bar 19 is locked down by securing screw 25 at contact point 21 the circuit breaker 1 has been bypassed and a renewed flow of current by the conventional direct ground route through cable 24 restores the electrical circuit. Connection to contact point 21 would be necessary if the electrical circuit is broken as shown in FIG. 2 due to concussive distortion of the circuit breaker 1 as would occur in a collision. Manual movement of conductor bar 19 would be performed after the danger of fire has subsided. Manually moving conductor bar 19 to contact point 22 and threadedly affixing securing screw 25 thereto safeguards the electrical system with the circuit breaker 1 as shown in FIG. 1 with battery cable 9 making the continuity between bypass switch 15 and circuit breaker 1 complete. If the vehicle requires servicing, power may be isolated by moving conductor bar 19 to neutral point 23 and rotatably and threadedly connecting securing screw 25 thereto, as illustrated in the detail of FIG. 3.

Referring to a further detail in FIG. 3, cable junction post 27, a solid conductive cylinder, is supported for a top mount battery assembly by the extension 17A on the base of shield 17, as illustrated. Mounting screw shaft 27A is integrally formed to the larger diameter bottom plane of the junction post 27. The smaller diameter top plane of junction post 27 contains an opening 27B patterned to receive a hexagonal wrench (not shown) for rotatably securing and removing junction post 27. Mounting screw shaft 27A is inserted into ground cable end disc 28. When secured to conventional ground cable end disc 28 and the conventional ground cable clamp (not shown) is fastened by a nut and a bolt (not shown) onto junction post 27, continuity is established.

Contact means 21, 22, and base member 16 are secured to the horizontal bottom plane of shield 17 by contact fasteners 26 at points 26A, 26B, and 26C. Contact fasteners may be made of metal, nylon or other suitable material. Slits in shield 17 at points 26A, 26B, and 26C allow fasteners to hold contact point means 21, 22, and base member 16 securely to shield 17. Rubber grommets 30 hold cables firmly in place on bypass switch shield rear panel. Connecting cable 9 is secured to the bypass switch shield extension 17A by metal or nylon retainer 31. Cable 24 is secured to the bypass shield extension 17A by metal fastener 29. The bypass switch 15 as mounted on shield 17 is enclosed inclusive of the battery terminal, but exclusive of the conventional ground cable end disc 28, by use of the shield lid 18 which is soft vinyl and snaps on and off for access to bypass switch 15. Shield lid 18 is held securely in place by elastic strap 32. Strap 32 has first perpendicular projection 32A on one end, and a second perpendicular projection 32B on the other end. Strap end projection 32A is inserted in side panel slot 33. By extending beyond the edges of slot 33 the projection 32A holds to the side panel when strap 32 is fastened. A rigid rectangular clasp 34 having a center slot is mounted on the opposite side panel of shield 17. Strap end projection 32B slides into clasp 34, and is held in place by the tension caused by the elasticity of strap 32.

Taking into account the description and drawings provided in this disclosure makes it apparent that all the stated objectives of the invention have been achieved.

While this invention has been presented and illustrated in the preferred embodiment, it will be evident to anyone skilled in the art that variations and modifications may be resorted to without departing from the spirit of this invention's disclosure. The foregoing is considered as illustrative only of the principles of the invention. Further, it is not desired to limit the invention to the exact construction and operation shown and described. Variations and modifications are considered to be within the scope of this invention as defined by the following claims.

The invention claimed is:

1. Within the electrical supply system of an internal combustion engine, an electrical circuit breaking fire prevention device comprising:

a ground connecting cable having a first end attached to a grounding point and having a second end with a first conductive capping cable end;

a first conducting single circuit coupling means;

a current carrying member;

a second conducting single circuit coupling means;

a battery connecting cable having a first end covered by a second conductive capping cable end, and a second end covered by an actuating conductive capping cable end;

a conductive connecting member;

a means for insuring a secure contact engagement;

a means for securing said conductive connecting member;

a conductive base member having a formed neutral contact point and a battery clamp formed thereon;

said ground cable attached to a grounding point and connecting via the first said conductive capping cable end to said first conducting single circuit coupling means;

said first conducting single circuit coupling means attached to the joining said current carrying member;

said current carrying member, being held within an insulating housing, providing continuity therethrough to the joining said second conducting single circuit coupling means;

said battery connecting cable attaching to said second conducting single circuit coupling means via the second said conductive capping cable end thereby providing the means for continuity to a said second cable end inserted within a battery bypass switch, said second cable end having a said actuating conductive capping cable end with a contact point formed therein;

said conductive base member affixed within the said battery bypass switch having a said neutral contact point formed therein which when connected via said means for insuring a secure contact engagement, said connection is unaffected by variation in position, level or frequency of use, and said base member having a formed battery clamp positioned over an opening in the battery bypass switch shield wherein the passage of the post of a storage battery is allowed;

said conductive connecting member attached to said conductive base member by the said means for securing said conductive connecting member, said conductive connecting member turns in place about securing pivot means to make connection with said actuating conductive capping battery cable end and its formed actuating contact point;

whereby continuity is established through said circuit breaker when said means for insuring a secure contact engagement is attached thereto at the said formed actuating contact point, and further the fire preventive device being automatically actuated upon abnormal structural distortion and destruction of said insulating housing containing the said conductive current carrying member, said fire preventing device being practical for vehicles and aircraft.

2. A circuit breaker fire prevention device for vehicles and aircraft wherein the battery bypass switch comprises:

a conductive base member;

a conductive connecting member;

a means for securing said conductive connecting member;

a means for insuring a secure contact engagement;

a first contact point means;

a second contact point means;

a third contact point means;

a first cable;

a first cable end means;

a junction point means;

a said battery connecting cable;

said conductive base member affixed within said battery bypass switch having the said third contact point means comprising neutral formed therein and a formed battery clamp positioned wherein the passage of the terminal post of a storage battery on the negative pole is allowed;

said conductive connecting member attached to said conductive base member by the said means for securing said conductive connecting member from which said conductive connecting member turns in place to make connection with a said first, a said second and a said third contact point means;

said first contact point means fastened to said first cable end means and said junction point means in electrical series providing the connection means wherein access to the conventional ground circuitry is attached by a clamp, the first contact point comprising the deactuated position wherein restoration of power occurs when said conductive connecting member aligns with the said first contact point means and said means for insuring a secure contact engagement is attached thereto;

said second contact point means fastened to said battery connecting cable wherein continuity is established to the said circuit breaker fire prevention device, the second contact point comprising the actuated position when said conductive connecting member aligns with said second contact point means and said means for insuring a secure contact engagement is attached thereto;

said third contact point means wherein electrical power present in the storage battery is isolated when said conductive connecting member aligns with said third contact point means formed in said conductive base member and said means for insuring a secure contact engagement is attached thereto;

whereby the improvements comprise the said restoration of continuity occurring without need for a specific directional relationship to the force of gravity, and the said isolation of power occurring according to frequency of need without restricting use of said isolating contact point to preserve the condition of the said conductive terminal on said storage battery, and the said continuity to the said circuit breaking fire prevention device occurring without the consequences of overheating.

3. A circuit breaker fire prevention device as claimed in claim 1 wherein the current carrying member comprises a series of segmented, joined, continuous electrical contacts, each of said electrical contacts having a non-conductive shell containing a core of conductive material, said shell and said core maintaining a spaced relationship between the said individual contacts in an interlocking unified chain of contacts coupling to the first and second conducting single circuit coupling means in electrical series, whereby the current carrying member is formed being vacuum packed on diverse occasions in an arrangement providing for the partial or total destruction of said member upon need for fire protection.

4. A circuit breaker fire prevention device according to claim 3 wherein each of the said conducting single circuit coupling means include integral means for threadedly and rotatably. applying adjustable pressure to the said interlocking electrical contacts and integral means for recessed abbutted projections connecting thereto.

5. A battery bypass switch according to claim 2 wherein the junction point means includes integral means for threadedly and rotatably affixing to the interior battery terminal opening for a side mount battery by the insertion of a hexagonal wrench into a said patterned opening in the top plane of said junction point means whereby exterior means for fastening a conventional battery cable fitted with a clamp is provided.

* * * * *